United States Patent [19]

Nozaki

[11] Patent Number: 4,848,616

[45] Date of Patent: Jul. 18, 1989

[54] ELECTRIC IMMERSION HEATING UNIT WITH READILY REMOVABLE AND REPLACEABLE GALVANIC CURRENT CONTROL RESISTOR

[75] Inventor: Michio B. Nozaki, LaGrange, Ill.

[73] Assignee: Rheem Manufacturing Company, Chicago, Ill.

[21] Appl. No.: 11,320

[22] Filed: Feb. 5, 1987

[51] Int. Cl.[4] ..... F24H 1/20; H05B 3/82

[52] U.S. Cl. ..... 219/322; 204/197; 219/316; 219/318; 219/335

[58] Field of Search ..... 219/312, 316, 318, 322, 219/335, 336, 523; 204/197

[56] References Cited

U.S. PATENT DOCUMENTS

| | | | |
|---|---|---|---|
| 2,723,340 | 11/1955 | Boggs et al. . | |
| 2,726,315 | 12/1955 | Fleming . | |
| 2,786,931 | 3/1957 | King | 219/336 |
| 2,810,815 | 10/1957 | Dicome | 219/322 X |
| 2,947,846 | 8/1960 | Fox | 219/322 X |
| 3,056,879 | 10/1962 | Fischer . | |
| 3,116,401 | 12/1963 | Drugmand . | |
| 3,176,115 | 3/1965 | Balis | 219/318 |
| 3,193,662 | 7/1965 | Brant | 219/336 |
| 3,217,138 | 11/1965 | Drugmand | 219/322 X |
| 3,414,707 | 12/1968 | Aldous | 219/322 |
| 3,769,493 | 10/1973 | Zeitlin et al. | 219/335 |
| 3,772,498 | 11/1973 | Temple | 219/336 |
| 3,860,787 | 1/1975 | Strobach | 219/336 |
| 3,943,328 | 3/1976 | Cunningham | 219/335 |
| 4,152,578 | 5/1979 | Jacobs | 219/336 |
| 4,543,469 | 9/1985 | Cunningham | 219/322 X |

*Primary Examiner*—Anthony Bartis

*Attorney, Agent, or Firm*—Allegretti & Witcoff, Ltd.

[57] ABSTRACT

An electric immersion heating unit for use in conjunction with a metallic water heater tank provided with a sacrificial anode has the legs of a U-shaped metallic sheathed heating element extending in electrically insulated relationship through a metallic plug adapted to operatively secure the heating unit in a tank opening. A cylindrical galvanic current flow controlling resistor is positioned in a slot between a disc shaped insulator on the outer face of the head and a terminal block receiving the ends of the heating element legs. A C-shaped metallic retaining clip in a groove about the perimeter of the terminal block maintains one end of the resistor in electrical contact with the metallic heating element sheath and establishes electrical contact between the other end of the resistor and the outer face of the head to provide a circuit of fixed resistance between the heating element sheath and the tank wall.

5 Claims, 3 Drawing Sheets

ELECTRIC IMMERSION HEATING UNIT WITH READILY REMOVABLE AND REPLACEABLE GALVANIC CURRENT CONTROL RESISTOR

BACKGROUND OF THE INVENTION

In a principal aspect, the present invention relates to an improved resistor subassembly for use in an immersion heating element in an electric water heater tank, the tank having a protectively coated interior and a sacrificial anode immersed therein.

Electric water heaters or tanks have typically been provided with a protective magnesium rod which is adapted to be immersed in the water in the interior of the tank. This magnesium rod, or sacrificial anode, is installed to protect the interior wall of the tank against the formation of rust in the even of an imperfection in the protective coating of the tank wall. The sacrifical anode protects the lining of the tank by setting up galvanic currents between itself and the unprotected portion of the tank wall, thereby causing magnesium from the rod to become deposited upon the unprotected portion of the tank. This plating action thus protects the interior of the tank against corrosion.

A problem associated with the use of magnesium sacrificial anodes in water heater tanks having conventional electric immersion heating elements is that the magnesium rod is rapidly consumed due to the galvanic action set up between the rod and the heating element. This galvanic action effects transference of magnesium from the rod to the heating element, since the bare metallic sheath of the heating element presents a considerable surface area. Thus, the magnesium rod is rapidly dissipated.

To protect the magnesium rod from rapid dissipation and the resulting loss of the tank wall protection relatively early in the tank's useful life the heating element is eletrically insulated from the tank wall. This insulation breaks the galvanic circuit between the magnesium rod and the heating element electrically connected to the tank and thereby preserves the life of the magnesium rod.

A more serious problem results, however, from the insulation of the heating element from the tank wall. A certain amount of galvanic current flow still passes between the magnesium rod and the heating element, the current completing the circuit between the heating element and the tank wall by passing through the water in the tank. This results in serious corrosion of the heating element sheath and early failure of the heating element when the corrosion reaches the sheath.

Thus, it is advantageous to allow a small, predetermined amount of galvanic current flow between the heating element sheath and the tank wall of the water heater tank. This is accomplished typically by operatively interposing a resistor between the heating element sheath and the tank wall.

In a typical resistor-type immersion heater element, complex schemes to interpose a resistor between the tank wall and the heating element sheath have been suggested. Examples of these prior art resistor immersion heater elements are disclosed in U.S. Pat. No. 2,723,340, issued to Boggs et al. on Nov. 8, 1955, and U.S. Pat. No. 3,414,707, issued to Aldous on Dec. 3, 1968. These prior art resistor immersion heater elements employ multiplicity of specialized parts and are exceedingly difficult to construct and maintain.

These prior art devices, because of their complex design, are relatively fragile and easily broken. When repair becomes necessary, it may be less expensive to replace the entire heating element rather than the individual subassembly that becomes inoperative.

The present invention constitutes an improved resistor subassembly for a resistor-type immersion heating element that seeks to overcome the problems discussed while at the same time providing a simple, easily constructed design that is readily adaptable to a variety of immersion heating elements.

SUMMARY OF THE INVENTION

Briefly, the present invention comprises an improved resistor mounting arrangement for an immersion heating element for use in a water heater tank having a sacrifical anode. In a resistored immersion heating element of the type operatively interposing a resistor between the heating element sheath and the tank wall, the improved resistor subassembly has a receiving head, means for electrically insulating the heating element sheath from the receiving head, a disc shaped insulator adjacent and outward from the receiving head, a terminal block outward from the disc shaped insulator, a resistor having a first end and a second end, and a C-shaped metallic retaining clip.

The terminal block is partially adjacent the insulator and extends beyond the heating element sheath. The block has a perimeter, front face and back face, and is adapted to receive the heating element sheath. The block further has a groove around its perimeter and adjacent the insulator. A resistor receiving slot in the block extends from the groove to the heating element sheath and is adjacent the front face of the block.

The resistor is positioned in the receiving slot, having its first end adjacent the heating element sheath. The metallic clip is adjacent the second end of the resistor and the receiving head, and maintains the resistor in operative association with the receiving head and the heating element sheath to provide a circuit of fixed resistance between the heating element sheath and the tank wall.

Thus, it is an object of the present invention to provide a resistor mounting arrangement for a resistor immersion heating element for use in an electric water heater wherein the resistor can be selected from a readily available supply and need not be specially manufactured for use in the apparatus.

Another object of the present invention is to provide a mounting arrangement for a resistor immersion heating element for use in an electric water heater that can be readily repaired, should the need arise, by substitution of only that element needing repair.

Yet another object of the present invention is to provide a mounting arrangement for a resistor immersion heating element that is easily installed and removed from the water heater tank.

Another object of the present invention is to provide a subassembly for a resistor immersion heating element that is sturdy and will withstand rough handling during shipment and water heater assembly.

It is a further object of the present invention to provide an easily constructed and operated apparatus having few specialized parts.

These and other objects, advantages, and features of the present invention will be apparent from the detailed description that follows.

BRIEF DESCRIPTION OF THE DRAWING

In the detailed description that follows, reference will be made to the drawing comprised of the following figures.

DETAILED DESCRIPTION OF A PREFERRED EMBODIMENT

Figure 1:
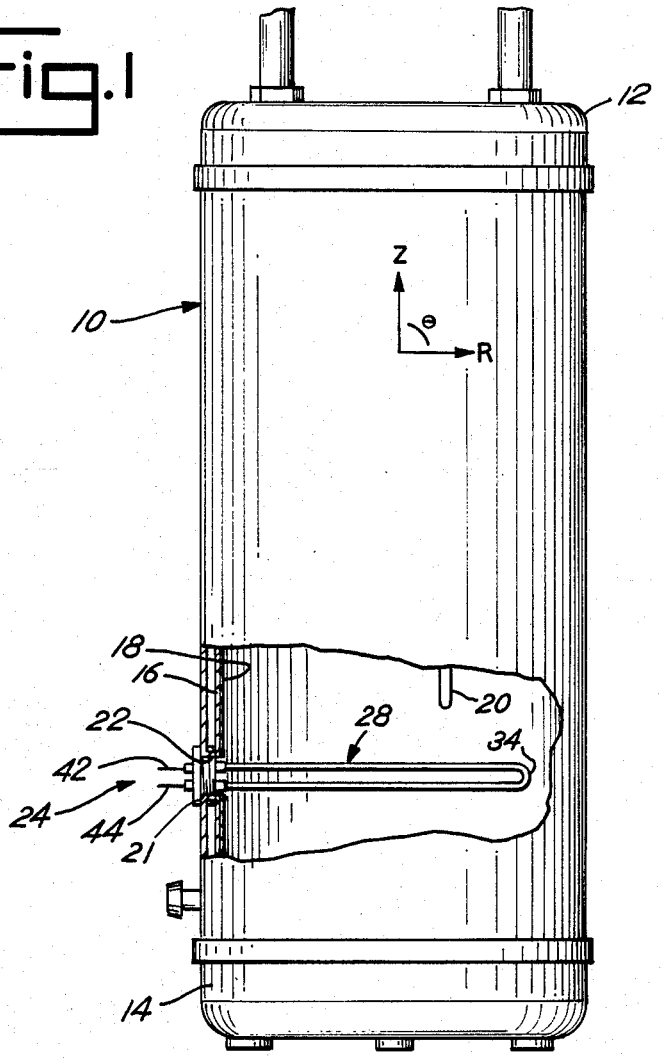
FIG. 1 is a partially cutaway side elevation of an electric water heater tank incorporating preferred embodiment of the present invention.

FIGS. 1-5 depict a specific embodiment of the invention. Referring therefore to FIG. 1, an electric water heater tank 10 is cylindrical and has a top 12, a bottom 14 and a cylindrical side wall 16. The tank 10 defines axial (Z), radial (R) and circumferential ($\theta$) directions. The interior of the tank wall 16 has a protective coating 18 (normally a glass coating) to prevent corrosion of the tank wall 16. The tank 10 is provided with sacrificial anode 20, typically constructed of magnesium, vertically supported in tank 10 in a manner known to those of ordinary skill in the art. The tank wall 16 has a through passage 21 with threaded, head receiving coupling 22 for receiving an electrical immersion heating unit 24.

Figure 2:
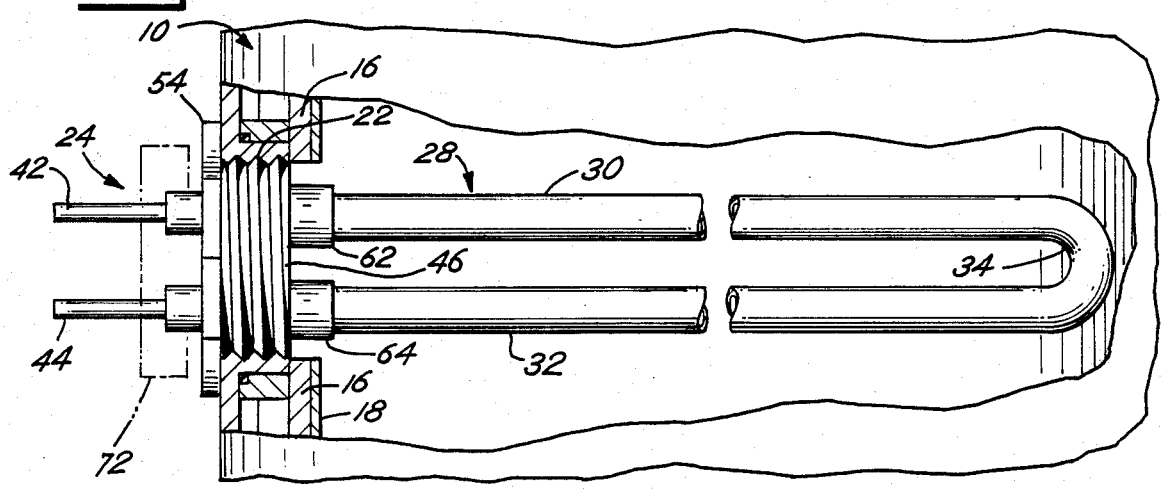
FIG. 2 is an enlarged view of the electric heating element for a water heater tank depicted in FIG. 1.

As shown in FIG. 2, a preferred form of the present invention includes an immersion heating unit 24. The heating unit. The heating unit 24 includes a U-shaped heating element 28 having a first leg 30, a second leg 32 and a semicircular section 34 connecting the legs 30 and 32. The legs 30 and 32 are substantially parallel to one another.

Figure 3:
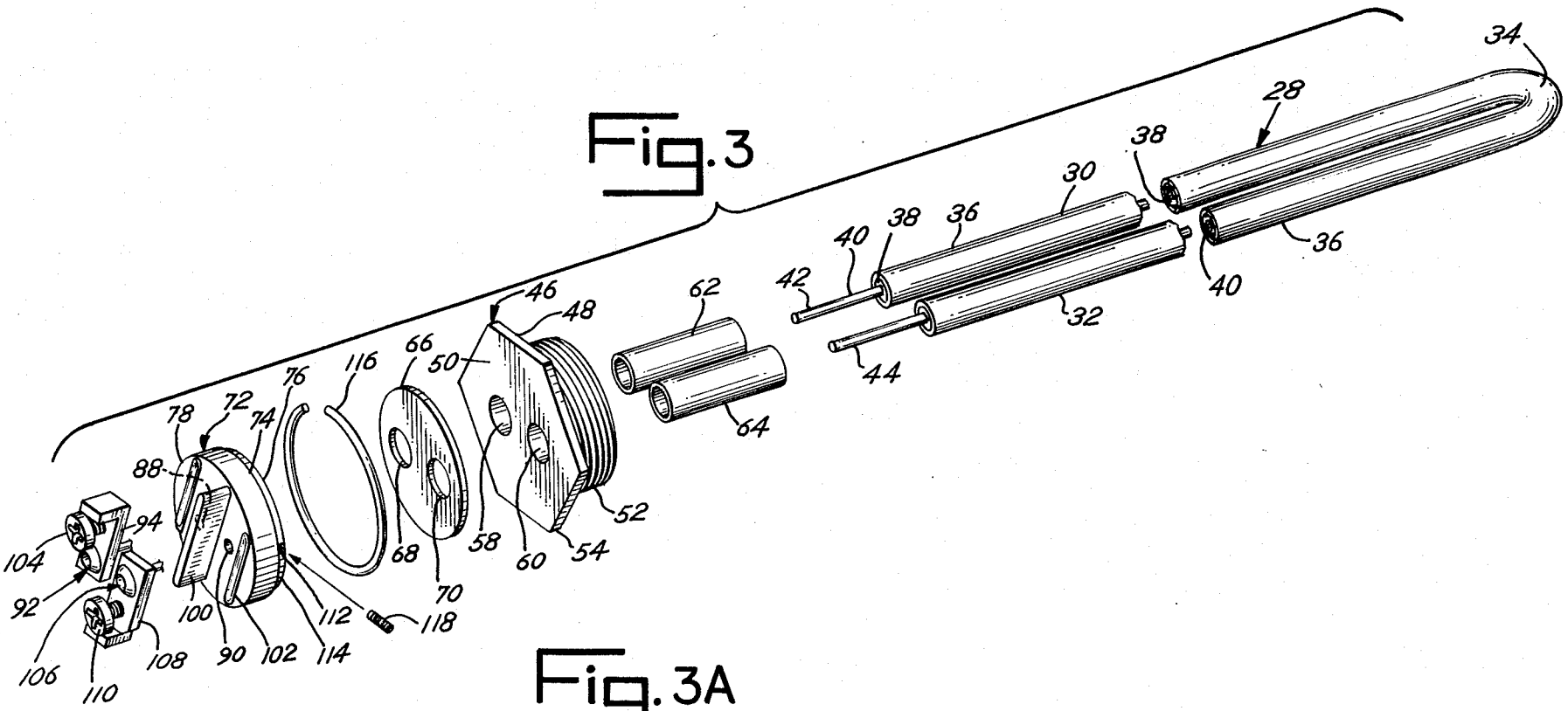
FIG. 3 is an perspective view of the heating element shown in FIG. 2, FIG. 3A being an exploded perspective view of a resistor incorporated into the preferred embodiment shown.

As shown in FIG. 3, the U-shaped heating element 28 includes a tubular copper sheath 36 surrounding an insulating material 38 which, in turn, encapsulates a resistance element 40 having opposite end connectors or leads 42, 44 projecting from the respective legs 30, 32. The heating element 28 extends radially into the tank 10, through the wall 16 as shown in FIG. 1, with the end connectors 42, 44 extending outside the tank wall 16. The semicircular section 34 is within the tank 10, as shown in FIG. 1. Although the drawing illustrates a heating element 28 in the shape of U, having two legs, it is understood that a myriad of shapes or configuration may be provided so long as the resistance element is contained with a sheath 36.

A metallic receiving plug 46 has an inside face 48, an outside face 50, a cylindrical body 52 and a flange 54. The cylindrical body 52 is screw-threaded for installation into the threaded, plug receiving coupling 22 welded to the tank wall 16. Thus, the screw-threading provides means for securing the plug 46 in the water heater tank 10. The receiving plug 46 is thus in electrically conductive relationship with the tank wall 16. The faces 48, 50 are perpendicular to the heating element legs 30, 32. The receiving head 46 has two parallel passages or throughbores 58, 60 adapted for receiving the heating element legs 30, 32.

Two insulation sleeves 62, 64 fit through passages 58, 60 and around the respective heating element legs 30, 32, thereby being interposed between the legs 30, 32 and the receiving plug 46. The sleeves 62, 64 extend beyond the head faces 48, 50 and maintain the legs 30, 32 electrically insulated from the receiving plug 46. Thus, the sleeves 62, 64 provide means for maintaining the legs 30, 32 in insulated relation to the receiving plug 46.

Means for securing the legs 30, 32, the sleeves 62, 64 and the head 46 in fixed relation with one another are provided by crimping the plug 46 around passages 58, 60 against the sleeves 62, 64 and legs 30, 32. Thus, the means for securing the legs 30, 32, the sleeves 62, 64 and the plug 46 in fixed position, in combination with the means for securing the plug 46 in the tank 10, provide means for securing the heating unit 24 in position in the tank 10. A rubber ring insulator 56 seals plug 46 to the coupling 22 to provide a watertight seal.

A disc shaped insulator 66 is positioned over and against the outer face 50 of the receiving plug 46. The insulator 66 has two openings 68, 70 that are aligned with the receiving head passages 58, 60 and receive the heating element legs 30, 32. The insulator 66 is also electrically non-cnductive.

A terminal block 72 is positioned and retained against the disc shaped insulator 66. The block 72 has a perimeter 74, an inside face 76 and an outside face 78. Block 72 includes pair of counterbores 80, 82 in the inside face 76 for receipt of the outer ends of the heating element legs 30, 32. Respective opposite end leads 42, 44 of resistance element 40 extend from the legs 30, 32, respectively, and project through openings 88, 90 extending from the counterbores 80, 82 through the outside face 78 of block 72. Connection of the leads 42, 44 to a power source provides means for passage of an electric current through the resistance element 40.

The lead 42 (also known as a "cold pin") projects through a first passage 92 in a first conductive, terminal plate 94. Plate 94 is retained in a longitudinal slot defined by parallel ridges 98 and 100 on the outside face 78 of the block 72. The lead 42 is deformed and welded at its outer end to the plate 94 and is an integral part of plate 94. Thus the block 72 is retained in position on the plug 46. The plate 94 includes a lead screw 104 for attachment of a leadwire (not shown) to a power source for the heating element 24.

In like fashion, lead 44 cooperates with a second passage 106 in a second plate 108 positioned between parallel ridges 102 and 100. Lead 44 is likewise attached to its associated plate 108. Plate 108 also includes an attached power source leadwire screw 110. Note that the block 72 is made from an insulating material and thus is not electrically conductive. Ridge 100 separates the plates 94 and 108 electrically.

A critical feature of the invention comprises the further construction of the terminal block 72. A radial slot 112 is provided in the block 72 and extends from the perimeter 74 thereof inwardly to the passage 80 for the heating element leg 30. The block 72 also includes a circumferential groove 114 about the outer perimeter 74 at the inside face 76. The groove 114 intersects the slot 112 and is adapted to receive an appropriately sized cooperative C-shaped, metallic and conductive retaining clip 116. The clip 116 encircles the block 72 and fits over the radial slot 112.

Figure 3A:
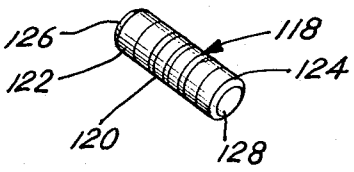
Figure 5:
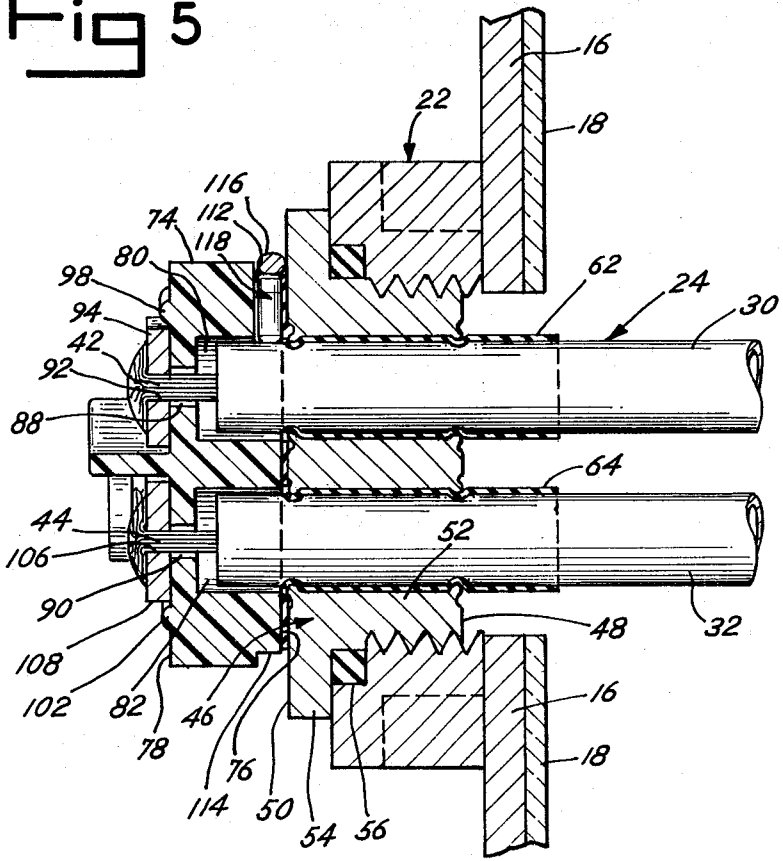
FIG. 5 is a side, cross-sectional view of the top end of the element taken along the line 5—5 in FIG. 4.
Figure 4:
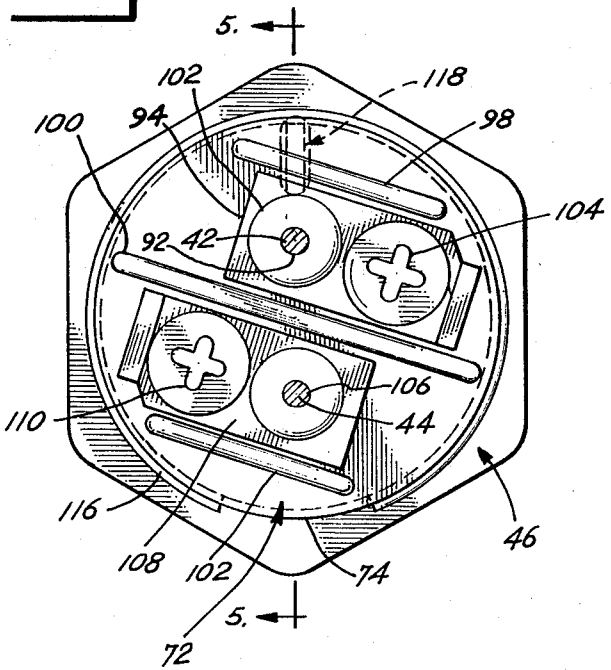
FIG. 4 is a top plan view of the terminal block of the heating element shown in FIG. 3.

Positioned within the slot 112 is a cylindrically shaped resistor 118. This galvanic current control. 118 has a length along the axis of its cylindrical shape just slightly greater than the length of the slot 112. Thus, the clip 116 has an inner diameter of the insulator 66 so as to be securely received around the insulator 66. The clips 116 further has a thickness approximately the same as the circumferential groove 114 so as to be securely received therein. The clip 116 thereby contacts the face 50 of the plug 46 as shown in FIG. 5. The opposite ends 122, 124 of the resistor are coated by a conductive metal cap or plate 126 and 128 as shown in FIG. 3A. An electrical path is thus provided between the conductive sheath 36 of leg 30 through the resistor 118 to the C-clip 116 and then through the plug 46. Inasmuch as the plug 46 is conductive, electric current will flow from the plug 46 to the wall 16 of the tank. In this manner a complete electric circuit having a controlled resistance between the sheath 36 and the tank 10 is provided. The resistance prevents excessive current drain off and thus corrosion of the sheath 36. The resistance prevents excessive current drain off and thus type is on the order of four to six hundred ohms and is most typically 550 ohms.

The particular construction of the resistor 118, the spring or C-clip 116 and the block 72 may be altered. Importantly, the construction depicted permits ease of replacement of the resistor 118 in the event of failure or in the event,if it is desired or necessary, to alter the current flow in view of various conditions associated with the wave heater 10. This provides an improved dimension of flexibility for the resistor mounting arrangement the present invention.

Various other changes may be made within the spirit and scope of the invention. Thus the invention is to be limited only by the following claims and their equivalents.

What is claimed is:

1. In an electric immersion heating unit for use in conjuction with a metallic water heater tank having a sacrificial anode, the heating unit being adapted to project into the water heater tank and including a heating element with a leg having a tubular, conductive, metallic sheath about an internal, electrically insulated resistance element, means for passage of an electric current through the resistance element to produce heat, means adapted to secure the heating unit in position in the water heater tank, and resistor means for regulating a galvanic flow of electric current through the heating element sheath between a sacrificial anode of the tank and the tank wall, the improvement, wherein said securing means comprises, in combination:

a metallic plug having an outside face and means for securing said plug to the water heater tank, the plug being adapted to be in electrically conductive relationship with the tank wall when so secured, the plug being provided with a passage through which the end of the heating element leg extends beyond the outer face of the plug:

means for maintaining the leg in the passage electrically insulated from the metallic receiving plug;

an insualtor sheet positioned adjacent the outside face of the metallic receiving plug, the insulator sheet having a hole receiving said end of the heating element leg and being electrically non-conductive;

a terminal block positioned against the insulator sheet, said block extending beyond the end of the heating element leg, the block having a perimeter, an outside face, and an inside face and including a passage in its inside face receiving the end of the heating element leg, said block having: a groove around said perimeter at said inside face and adjacent the insulator sheet, and having a resistor receiving slot in the inside face of the block and extending from the groove to the leg receiving passage of the block:

said resistor means comprising a generally cylindrical resistor having a first electrical contact end and second electrical contact end, the resistor being interposed between the termianl block and the sheet insulator and within the terminal block resistor receiving slot, said first end being in contact with the metallic sheath of the heating element leg and a C-shaped, electrically conductive metallic retaining clip in the terminal block groove and electrically contacting both the second end of the resistor and the plug;

the metallic retaining clip maintaining the resistor in operative electrical engagement with the receiving plug and the heating element sheath simultaneously to provide a circuit of fixed resistance between the heating element sheath and the tank wall.

2. The improvement of claim 1 wherein the resistor has a resistance in the range of about 500 ohms to 700 ohms.

3. The improvement of claim 1 wherein the means for passage of an electric current through the resistance element includes an electrical connector supported on the termianl block and connected to a lead wire connected to the resistance element.

4. The improvement of claim 2 wherein said heating element includes a second leg and the terminal block includes two passages in its inside face receiving said heating element legs, an opening extending from each passage to the outside face of the block, a first terminal plate against the outside face of the block, said means for passage of electric current through the resistance element includes a second separate terminal plate against the outside face of the block in spaced relation to said first plate and means for attaching terminal lead wires extending through said openings from the opposite ends of said resistance element respectively to said plates in position on the outside face of the block to retain the block insulator sheet and plug in assembled relationship.

5. The improvement of claim 4 wherein the outside face of the block includes a ridge for electrically separating said first plate from said second plate.

* * * * *